United States Patent [19]

Pollak

[11] Patent Number: 4,694,893

[45] Date of Patent: Sep. 22, 1987

[54] UNIT FOR GUIDING THE FLOW OF COLD GAS IN STEAM GENERATORS OF HIGH-TEMPERATURE REACTORS

[75] Inventor: Gerd Pollak, Gummersbach, Fed. Rep. of Germany

[73] Assignee: L. & C. Steinmüller GmbH, Gummersbach, Fed. Rep. of Germany

[21] Appl. No.: 868,242

[22] Filed: May 28, 1986

[30] Foreign Application Priority Data

May 28, 1985 [DE] Fed. Rep. of Germany ..... 3519038

[51] Int. Cl.[4] ..... F28F 9/22

[52] U.S. Cl. ..... 165/104.34; 165/160; 165/159; 122/32; 376/391

[58] Field of Search ..... 165/159, 160, 104.34; 122/32, 33; 376/391, 392

[56] References Cited

U.S. PATENT DOCUMENTS 3,929,188 12/1975 Brinkmann et al. ..... 165/104.34

4,504,439 3/1985 Elter et al. ..... 376/391

*Primary Examiner*—Albert W. Davis, Jr.

*Attorney, Agent, or Firm*—Becker & Becker, Inc.

[57] ABSTRACT

A unit for guiding the flow of cold gas from the annular chamber that is disposed between the pressure tank wall and the steam generator wall to the circulation fan of a steam generator of a high-temperature reactor, with hot gas being adapted to be supplied to the steam generator wall via a hot gas guide mechanism. The cold gas flows into a riser through a plurality of cold gas channels that pass through the upper end of compensating tube bundles that are associated with the steam generator wall. From the riser, the cold gas is supplied to the circulation fan, with the riser being disposed in that portion of the hot gas guide mechanism that extends parallel to the central axis of the pressure tank.

6 Claims, 1 Drawing Figure

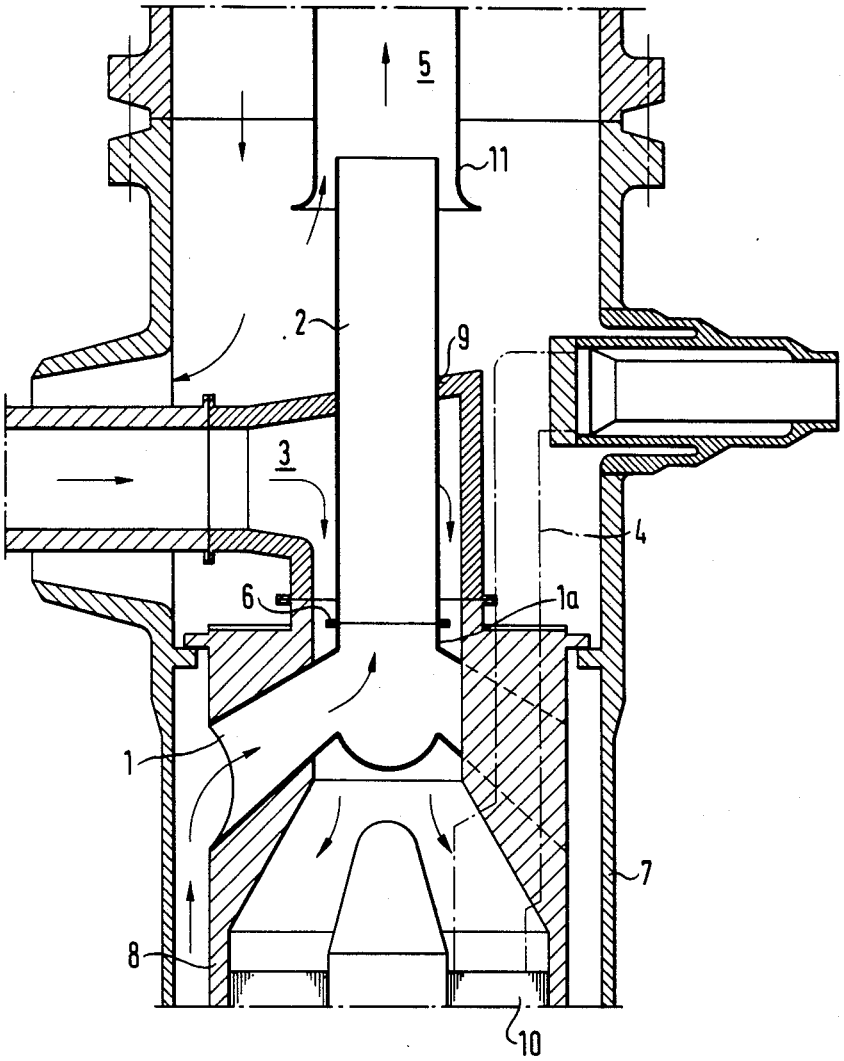
5
11
2
9
3
4
6
1a
1
7
8
10

UNIT FOR GUIDING THE FLOW OF COLD GAS IN STEAM GENERATORS OF HIGH-TEMPERATURE REACTORS

BACKGROUND OF THE INVENTION

The present invention relates to a unit for guiding the flow of cold gas from the annular chamber that is disposed between the pressure tank wall and the steam generator wall to the circulation blower, or the like of a steam generator of a high-temperature reactor, with hot gas being adapted to be supplied to the steam generator wall via a hot gas deflection or guide mechanism.

In steam generators for high-temperature reactors, the cooled heat-carrier gas that leaves the heat transfer surfaces of the evaporator is collected and is supplied to a circulation blower, fan, or the like.

Steam generators for high-temperature reactors are known where the cold gas flows upwardly concentrically to the wall of the steam generator and to the wall of the pressure tank, where it is collected in a cold-gas collector and is supplied to the circulation fan via a plurality of individual tubes that are distributed over the periphery of the pressure tank and are disposed in the immediate vicinity of the wall of the latter.

A significant drawback of such an arrangement is that the individual tubes that convey the cold gas surround the hot gas guide mechanism along with other components, thus considerably complicating mounting and dismantling of the hot gas guide mechanism.

It is therefore an object of the present invention to provide a simple configuration for guiding the cold gas to the fan, with this configuration assuring good accessibility to the connection elements and also assuring an unimpeded mounting and dismantling of the unit.

SUMMARY OF THE INVENTION

To realize this object, it is proposed that the cold gas flow into a riser through a plurality of cold gas channels that pass through the upper end of the compensating tube bundles that are associated with the steam generator wall, from which riser the cold gas is supplied to the fan, with the riser being disposed in that portion of the hot gas guide mechanism that extends parallel to the central axis of the tank. By combining the individual tubes to the inventively disposed riser and its connection with the cold gas channels, a particularly straightforward construction is achieved where the required connecting elements are very accessible.

The riser is advantageously either concentric or not concentric to the longitudinal axis of the guide mechanism in order to be able to adjust the way in which the hot gas strikes the heat transfer surfaces of the steam generator.

Furthermore, by providing a flange connection, the riser can be installed either along with the guide mechanism or separately.

It is also advantageous that by installing a flange connection between the cold gas channels and the riser, the latter can be assembled and dismantled either along with the guide mechanism or separately.

The point of connection where the riser passes through to the guide mechanism is embodied as either a fixed or detachable connection for a common or separate mounting.

BRIEF DESCRIPTION OF THE DRAWING

One specific embodiment of the inventive unit is illustrated in the drawing.

DESCRIPTION OF PREFERRED EMBODIMENTS

The cold gas that flows upwardly from the annular chamber between the steam generator wall 8 and the pressure tank wall 7 is supplied to the riser 2 via a plurality of cold gas channels 1 that pass through the compensating tube bundles 4; from there, the cold gas flows to the circulation blower, fan, or the like 5. The riser 2 is detachably connected via the flange connection 6 with a pipe section 1*a* that in turn is securely connected with the cold gas channels 1. The riser 2 is disposed in the deflection or guide mechanism 3 in such a way that it is concentric to the longitudinal or central axis of the latter. However, a non-concentric arrangement is also conceivable in order to be able to adjust the way in which the heat transfer surfaces of the steam generator are impacted. The point of connection 9 where the riser 2 passes through to the guide mechanism 3 is either fixed or detachable.

The free end of the riser 2 extends into a widened intake pipe or connector 11 in such a way that a portion of the gases from the pressure side of the fan 5 can flow directly back to the intake side.

The illustrated flow connection of the riser and the circulation fan is the preferred configuration.

The present invention is, of course, in no way restricted to the specific disclosure of the specification and drawing, but also encompasses any modifications within the scope of the appended claims.

What I claim is:

1. A unit for guiding the flow of cold gas from the annular chamber that is disposed between the pressure tank wall and the steam generator wall to the circulation fan of a steam generator of a high-temperature reactor, with hot gas being adapted to be supplied to said steam generator wall via a hot gas guide mechanism; said unit further comprising:

compensating tube bundles associated with said steam generator wall, with said compensating tube bundles having an upper end when viewed in the direction that gases rise;

a plurality of cold gas channels that pass through said upper end of said tube bundles and are adapted to receive cold gas from said annular chamber between said pressure tank wall and said steam generator wall; and a riser for receiving cold gas from said cold gas channels and conveying said cold gas to said circulation fan, with said pressure tank having a central axis and said hot gas guide mechanism having a portion that extends parallel to said central axis of said pressure tank, and with said riser being disposed in said portion of said guide mechanism that extends parallel to said central axis of said pressure tank.

2. A unit according to claim 1, in which said riser is concentrically disposed in said portion of said guide mechanism that extends parallel to said central axis of said pressure tank.

3. A unit according to claim 1, in which said riser is non-concentrically disposed in said portion of said guide mechanism that extends parallel to said central axis of said pressure tank.

4. A unit according to claim 1, which includes a flange connection between said cold gas channels and said riser to selectively provide common or separate mounting and dismantling of said riser and said guide mechanism.

5. A unit according to claim 1, in which said riser passes into said guide mechanism and is at that point fixedly connected to the latter.

6. A unit according to claim 1, in which said riser passes into said guide mechanism and is at that point detachably connected to the latter to selectively provide common or separate mounting of said riser and said guide mechanism.

* * * * *